US008920188B2

(12) United States Patent
Richardson

(10) Patent No.: US 8,920,188 B2
(45) Date of Patent: Dec. 30, 2014

(54) INTEGRATED CONNECTOR/FLEX CABLE

(71) Applicant: Silicon Image, Inc., Sunnyvale, CA (US)

(72) Inventor: Bruce A. Richardson, Cedar Rapids, IA (US)

(73) Assignee: Silicon Image, Inc., Sunnyvale, CA (US)

( * ) Notice: Subject to any disclaimer, the term of this patent is extended or adjusted under 35 U.S.C. 154(b) by 21 days.

(21) Appl. No.: 13/779,372

(22) Filed: Feb. 27, 2013

(65) Prior Publication Data

US 2014/0242834 A1 Aug. 28, 2014

(51) Int. Cl.
*H01R 3/00* (2006.01)
*H01R 12/59* (2011.01)

(52) U.S. Cl.
CPC ..... *H01R 12/59* (2013.01)
USPC ..... 439/497

(58) Field of Classification Search
USPC ..... 439/497, 489, 924.1
See application file for complete search history.

(56) References Cited

U.S. PATENT DOCUMENTS

| | | | | |
|---|---|---|---|---|
| 3,651,432 | A * | 3/1972 | Henschen et al. | 333/33 |
| 5,051,099 | A * | 9/1991 | Pickles et al. | 439/108 |
| 5,387,125 | A | 2/1995 | Davis et al. | |
| 6,165,008 | A | 12/2000 | Wu et al. | |
| 7,121,874 | B1 | 10/2006 | Jeon | |
| 2004/0072467 | A1 * | 4/2004 | Jordan et al. | 439/492 |
| 2006/0157271 | A1 | 7/2006 | Miura et al. | |
| 2010/0291790 | A1 | 11/2010 | Kiryu et al. | |

OTHER PUBLICATIONS

PCT International Search Report and Written Opinion, PCT Application No. PCT/US2014/015895, May 26, 2014, 10 pages.

* cited by examiner

*Primary Examiner* — Phuong Dinh
(74) *Attorney, Agent, or Firm* — Fenwick & West LLP

(57) ABSTRACT

A method and apparatus is disclosed herein for providing a connection between a connector and a flex cable. In one embodiment, the connector scheme comprises: a flex ribbon having first and second sides, the first side being opposite the second site, where the flex ribbon has one or more traces on the first side and a ground plane on at least a portion of the second side; and a connector into which the flex ribbon is inserted to make an electrical connection thereto, where the connector has a metal shell in electrical contact with the ground plane while having contacts in electrical contact with the one or more traces.

17 Claims, 6 Drawing Sheets

INTEGRATED CONNECTOR/FLEX CABLE

FIELD OF THE INVENTION

Embodiments of the present invention relate to the field of connectors for printed circuit boards (PCBs); more particularly, embodiments of the present invention relate to a connection scheme that electrically connects traces on a flex ribbon and with those in a connector into which the flex ribbon is inserted.

BACKGROUND OF THE INVENTION

Numerous communication systems support very high speed data rates. For example, many practical digital communication systems process data at speeds of up to 40 Gb/s. Practical high speed data communication systems employ a number of interconnected elements such as electronic devices, components, modules, circuit boards, subassemblies, and the like. High speed clock/data inputs and outputs of such elements require interconnection at the subsystem and system levels.

There are a limited number of interconnects that can be used for very high speed data communications. Connectors are often used for the interconnection of signal paths. Such connectors often are bulky, require difficult cable layouts and require specialized component packages and may introduce discontinuities in the signal path.

The present FR-4 printed circuit boards (PCBs) are strong and are commonly used today. However, FR-4 PCBs include connectors but are not good at conducting high frequency electrical signals. This is because they have a loss of signal strength and a distortion of pulse shape of pulses in the electrical signals depending on the path and the length that traces on the board. The loss of signal strength and distortion can be attributed in part to the location of the connector away from the signal path. For example, an output driver chip may be electrically connected to a PCB and the signals it receives and sends may suffer a loss of signal strength and distortion when the signals have to be routed over long distances and/or through the board to get to the connector. Thus, many PCBs layouts are designed to reduce those long distances so that the output driver chips are close to the connector.

Furthermore, other factors may determine the output driver chip be put some distance from the output connector on the back/side/edge of a mobile phone, TV, projector, etc. Various solutions have been proposed in the prior art that include the use of a more expensive PCB material, use of more layers, or reworking the board to place critical components closer together.

SUMMARY OF THE INVENTION

A method and apparatus is disclosed herein for providing a connection between a connector and a flex cable. In one embodiment, the connector scheme comprises: a flex ribbon having first and second sides, the first side being opposite the second site, where the flex ribbon has one or more traces on the first side and a ground plane on at least a portion of the second side; and a connector into which the flex ribbon is inserted to make an electrical connection thereto, where the connector has a metal shell in electrical contact with the ground plane while having contacts in electrical contact with the one or more traces.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

A ribbon microstrip, stripline or coplanar signal path is disclosed. In one embodiment, the signal path comprises traces on a ribbon flex. The signal path has good high frequency properties and may be used to conduct multi-Gb/s (HDMI) data into a connector.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Figure 1A:
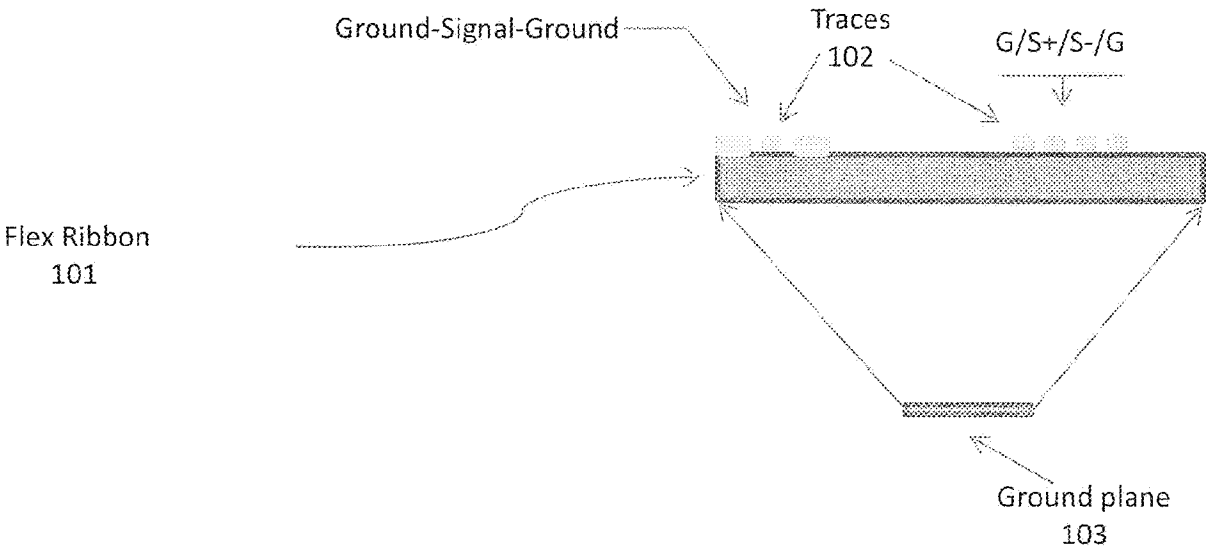
FIGS. 1A and 1B illustrate a flex ribbon according to one embodiment of the present invention.
Figure 1B:
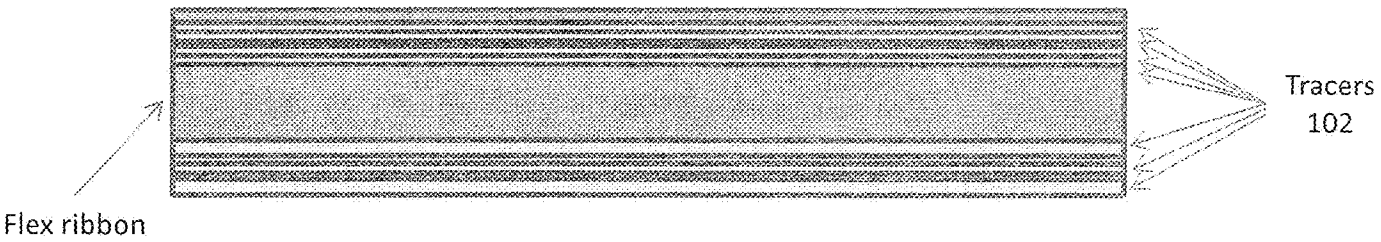

FIGS. 1A and 1B illustrate a flex ribbon according to one embodiment of the present invention. Referring to FIG. 1A, the flex ribbon 101 is shown with the traces 102 on top of flex ribbon 101. In one embodiment, flex ribbon 101 comprises a Kapton polyimide or other well-known material and traces 102 are made of copper. In alternative embodiments, silver, gold, graphene, conductive ink or other conductor defined by an additive or subtractive process may be used. In one embodiment, traces 102 include Ground/Signal/Ground lines and Ground/Signal+/Signal−/Ground lines. In another embodiment, traces 102 form a high speed 100 ohm differential signal path, a communications path, and a power supply and ground return path. One skilled in the art would recognize that the number of traces used is based on the application and use of flex ribbon 101.

The opposite side of flex ribbon 101 may include a ground plane 103. In one embodiment, ground plane 103 runs along the entire length of the bottom of flex ribbon 101. In an alternative embodiment, ground plane 103 runs along only a portion of the bottom of flex ribbon 101. In one embodiment, ground place 103 comprises a copper backplane.

In one embodiment, flex ribbon 101 with traces 102 and ground plane 103 form a high bit rate capable 50 ohm signal path(s) that extend all the way into a connector.

FIG. 1B illustrates a top view of flex ribbon 101 illustrating conductors 102 running along one side of flex ribbon 101.

Figure 2A:
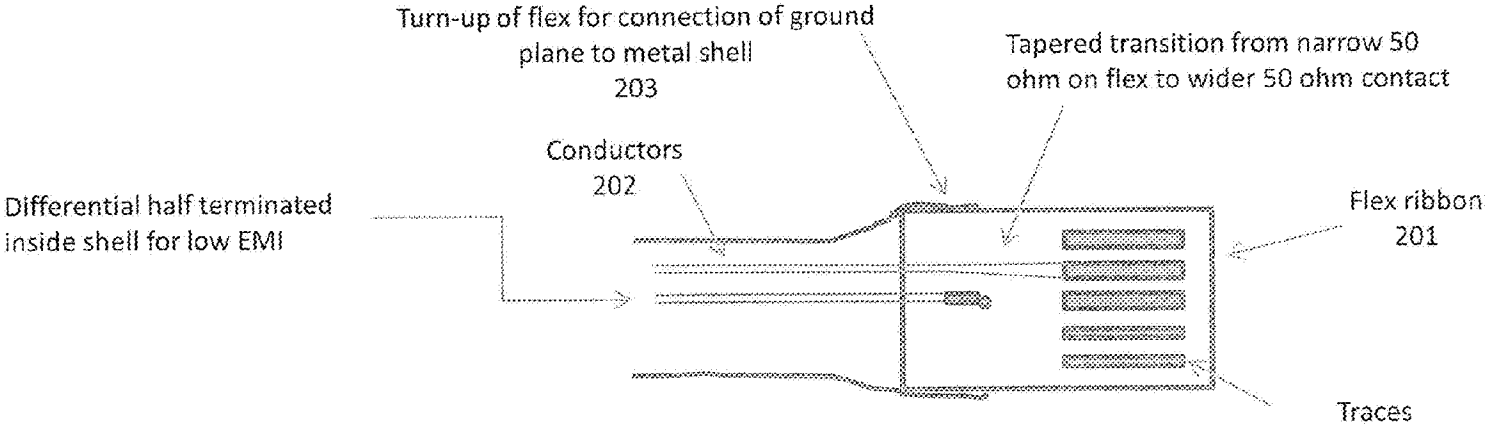
FIG. 2A-C illustrate another embodiment of a flex ribbon.

FIG. 2A illustrates another embodiment of a flex ribbon. Referring to FIG. 2A, flex ribbon 201 includes traces 202 that are coupled to contracts 205. In one embodiment, there is a tapered transition to each of one or more of contacts 205 from traces 202 on flex ribbon 201. In one embodiment, there is a tapered transition for all of traces 202 to contacts 205. The taper transition tapers from the thickness of each of contacts 205 down to the thickness of their respective one of traces 202. The realized form of the signal path is such as to optimize the signal integrity at high bit rates.

In one embodiment, because the flex cable can be inserted directly into the connector, a small surface mount resistor or other component is added in line or across the traces while maintaining the signal integrity.

Figure 2B:
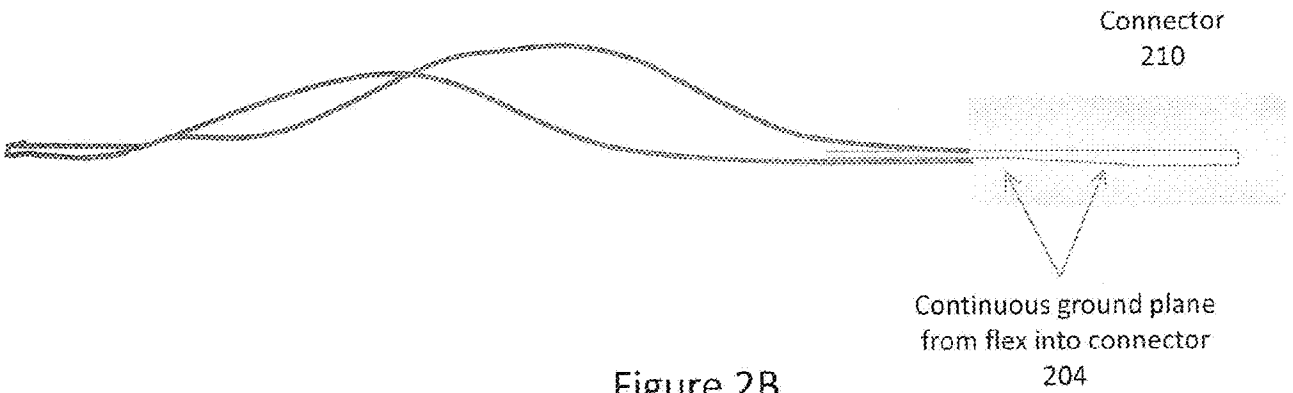
Figure 2C:
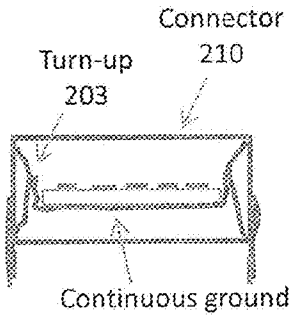

Flex ribbon 201 also includes turn-ups 203 that are used to connect grounds or ground plane 204 of flex ribbon 201 to a metal shell in the connector. FIG. 2B be illustrates the continuous ground plane 204 of flex ribbon 201 where flex ribbon 201 is inserted into a connector 210. FIG. 2C also shows the continuous ground plane 204 with turn-ups 203 making an electrical ground connection with a metal shell of connector 210.

In one embodiment, flex ribbon 201 comprises a Kapton polyimide or other well-known material, traces 202 are made of copper, and ground plane 204 is made of copper. In alternative embodiments, other materials such as, for example, gold, silver or aluminum might also be used. Those skilled in the art would recognize that other materials may be used.

Figure 3:
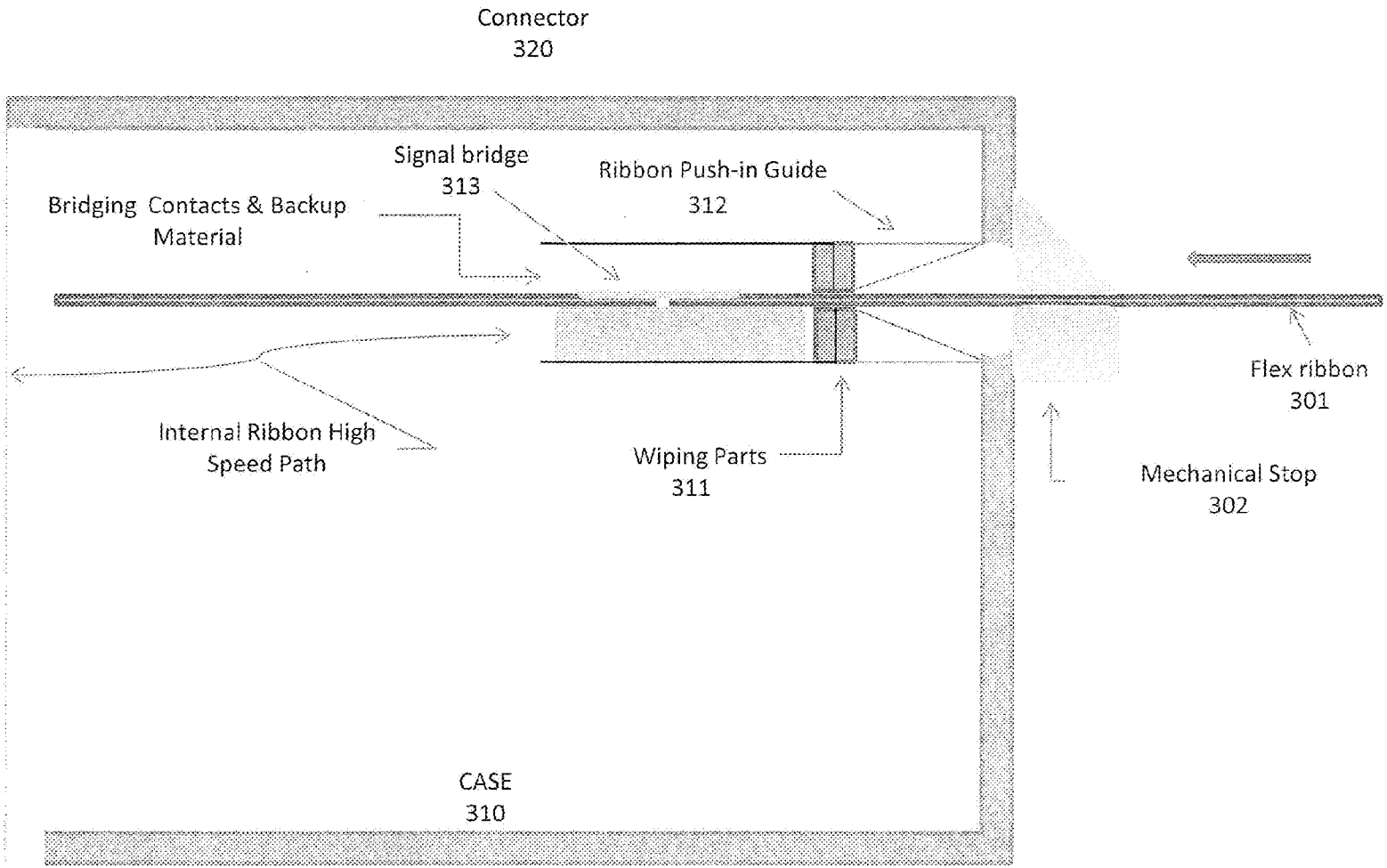
FIG. 3 illustrates one embodiment of a flex ribbon that is inserted into and in electrical contact with a connector.

FIG. 3 illustrates one embodiment of a flex ribbon that is inserted into and in electrical contact with a connector. Referring to FIG. 3, a flex ribbon 301 is inserted into case 310 of connector 320. Flex ribbon 301 has a mechanical stop 302 attached to it to prevent flex ribbon 301 from being inserted too far into case 310. In one embodiment, mechanical stop 302 comprises plastic. In alternative embodiments, other materials such as, for example, rubber and epoxy may be used.

Connector 320 includes wiping parts 311 that wipe one or both sides of flex ribbon 301 as its being inserted into case 310. In one embodiment, wiping parts 311 comprise a compliant material, "ultra wipe" finely woven material, or a non-abrasive material, which are well-known to those skilled in the art. In one embodiment, wiping parts 311 only clean traces and contacts on one side of flex ribbon 301. In another embodiment, wiping parts 311 clean both sides of flex ribbon 301. Note that in one embodiment, traces on flex ribbon 301 are covered with a protective layer (e.g., poly). In such a case, wiping parts 311 only clear contacts on flex ribbon 301.

In one embodiment, connector 320 includes a ribbon pushing guide 312 that causes flex ribbon 301 to be directed towards the aperture of the wiping parts when being inserted into connector 320.

Connector 320 also includes bridging contacts and backup material to facilitate a connection between contacts and/or traces on flex ribbon 301 and the contacts in connector 320. In one embodiment, signal bridge 313 connects the electrically connected contacts on flex ribbon 301 with those contacts in connector 320. Such contacts in connector 320 may be attached to an internal ribbon or signal path within connector 320. In one embodiment, signal bridge 313 comprises gold. In another embodiment, signal bridge 313 comprises a material (e.g., silver) that can be used to conduct efficiently. Such a material may be any material that electrically conducts signals, and includes materials that may tarnish yet have the tarnish itself still conduct (as opposed to acting as an insulator).

Signal bridge 313 makes electrical contact with the contacts on flex ribbon 301 and contacts of connector 320 via a backing material that applies a force between signal bridge 313 and the contacts. The backing material pushes down signal bridge 313 to ensure that there is electrical contact between the contacts on flex ribbon 301 and contacts of connector 320. In one embodiment, the backing material comprises an elastomeric material. In an alternative embodiment, the backing material may comprise a spring loaded insulator.

Figures 4A, 4B:
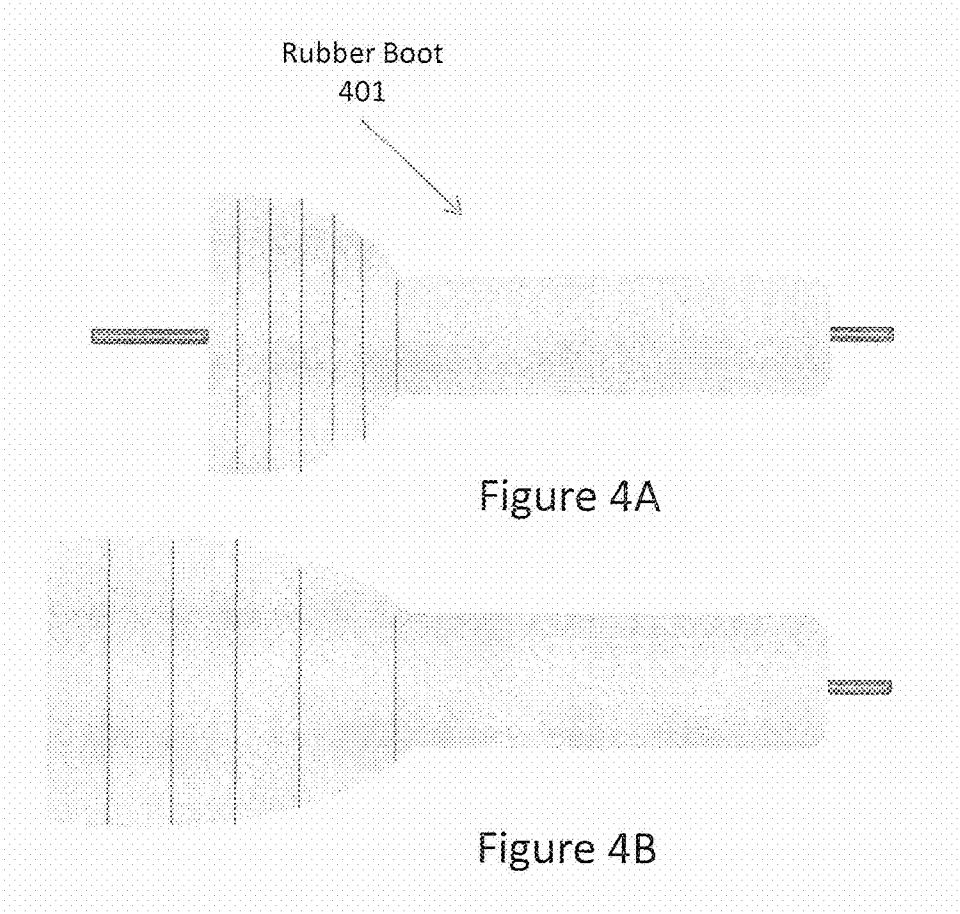
FIGS. 4A and 4B illustrates a rubber boot around a flex ribbon.

FIGS. 4A and 4B illustrates a holder, such as, a rubber boot 401 that may be used to hold the flex ribbon with a human hand when being inserted into a connector. In one embodiment, the rubber boot 401 is slidable between at least two positions along the flex ribbon such that the rubber boot protects the end of flex ribbon prior to insertion into a connector and then slides down the flex ribbon to enable the end of the flex ribbon to extend into the connector to make an electrical connection between contacts on the flex ribbon and contacts inside the connector. Other types of holders may be used and operate in the same or similar fashion.

Figure 5A:
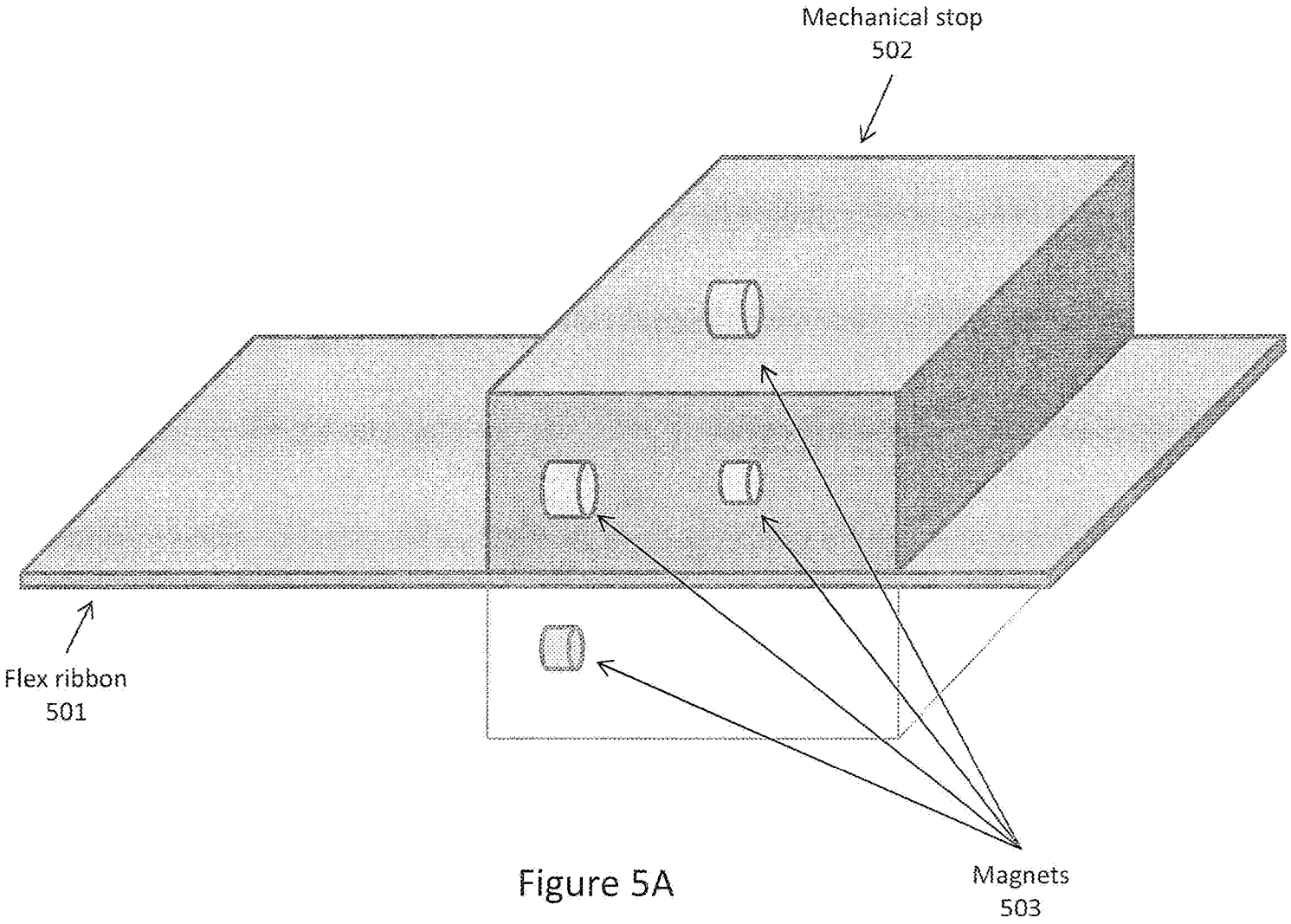
FIGS. 5A and 5B illustrate one embodiment of a flex ribbon and a connector that use magnets to maintain the flex ribbon in connection with the connector.

In one embodiment, one or more magnets may be integrated into the mechanical stop (or other portion of a structure) of the flex ribbon as well as the connector itself. These magnets are used to maintain the engagement between the flex ribbon and the connector when the flex ribbon is inserted into the connector. FIG. 5A illustrates one embodiment of a flex ribbon with a mechanical stop. Referring to FIG. 5A, flex ribbon 501 is shown with mechanical stop 502 that includes magnets 503. Magnets 503 are integrated into mechanical stop at locations that will line up with corresponding magnets in the connector to maintain the connection between flex ribbon 501 and the connector.

Figure 5B:
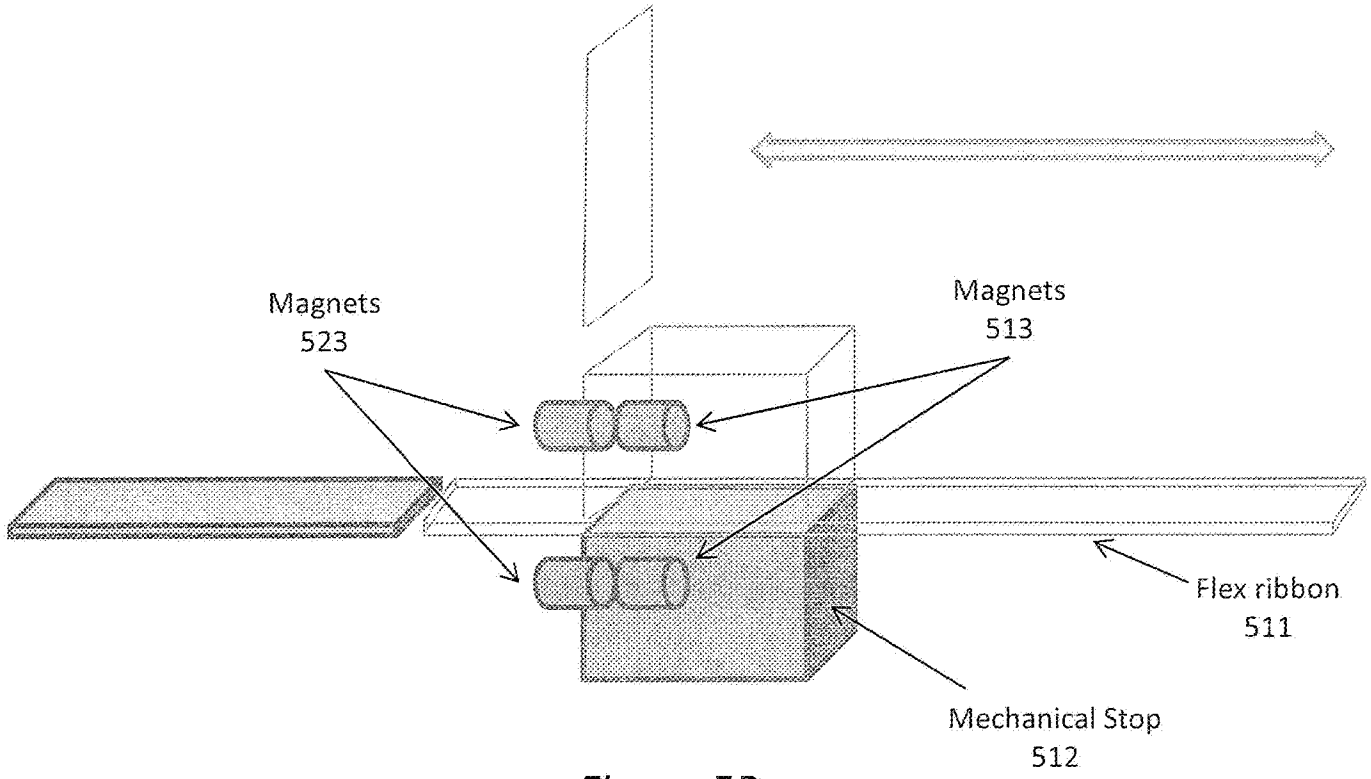

Referring to FIG. 5B, flex ribbon 511 is shown with mechanical stop 512 having magnets 513. Once flex ribbon 5011 has been inserted into the connector, magnets 513 line up with magnets 523 that are part of the connector (not shown to avoid obscuring the invention). The use of the magnets allows for a reduced force when disengaging flex ribbon 511 from the connector. Because flex ribbon 511 is flexible, twisting flex ribbon 511 causes the magnets 513 and 523 to misalign and thereby reduce the magnetic force holding flex ribbon 511 to the connector, allowing for easy disengagement.

In one embodiment, a two-sided flex ribbon connection scheme is used. In one embodiment, this scheme includes a ribbon with three layers: TOP: signal−, signal+ or ground, signal−, signal+, ground; MIDDLE: ground plane; BOTTOM: like top layer. Alternatively, two separate "single sided" flex ribbons back-to-back could be used. In such a case, both flex ribbons back-to-back go into one connector body.

In one embodiment, the connection scheme detailed herein may be used in a micro USB type application, such as a cellphone to TV connector: micro USB 5 pin: +5V, signal+, signal−, communication bar, ground.

There are a number of benefits associated with embodiments of the present invention. One benefit of the improved signal path is that the PCM/soldered connector pins and contacts of prior art connection schemes are eliminated. Further benefits include improved differential to signal-ended radiated power and connector or TX/RX relocation freedom without having to redesign the PCB (i.e., respin the PCB). Also, the improved integrated ribbon/connector can be tested and qualified to a high standard.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

I claim:

1. An apparatus comprising:

a flex ribbon comprising a first side and a second side opposite to the first side, the flex ribbon further comprising one or more traces on the first side and a ground plane on at least a portion of the second side; and a connector configured to receive and electrically connect the flex ribbon, the connector comprising:

a metal shell in electrical contact with the ground plane of the flex ribbon, contacts isolated from the metal shell in electrical contact with the one or more traces, and a signal bridge configured to electrically connect the contacts to the one or more traces.

2. The apparatus of claim 1, wherein the flex ribbon further comprises a mechanical stop.

3. The apparatus of claim 1, wherein the flex ribbon further comprises one or more contacts, each of the one or more contacts of the flex ribbon coupled to a distinct one of the one or more traces, and wherein at least one of the one or more traces has a tapered transition to its corresponding contact.

4. The apparatus of claim 1, wherein the connector further comprises a guide to direct the flex ribbon into the connector.

5. The apparatus of claim 1, wherein the connector further comprises one or more wiping parts to clean the flex ribbon when being inserted into the connector.

6. The apparatus of claim 1, wherein the signal bridge electrically connects the contacts of the connector to the contacts of the flex ribbon that are connected to the one or more traces.

7. The apparatus of claim 1, wherein the flex ribbon further comprises a holder to enable a user to hold the flex ribbon during insertion of the flex ribbon into the connector or removal of the flex ribbon from the connector.

8. The apparatus of claim 1, wherein the holder comprises a rubber boot.

9. An apparatus comprising:

a flex ribbon comprising a first side, a second side opposite to the first side, one or more traces on the first side, a ground plane on at least a portion of the second side, the flex ribbon comprises and one or more magnets; and a connector configured to receive and electrically connect the flex ribbon, the connector comprising:

a metal shell in electrical contact with the ground plane of the flex ribbon, contacts isolated from the metal shell, the contacts in electrical contact with the one or more traces, and one or more magnets which align with the one or more magnets of the flex ribbon to secure the flex ribbon with the connector.

10. The apparatus of claim 9, wherein the one or more magnets of the flex ribbon are part of a mechanical stop of the flex ribbon.

11. The apparatus of claim 9, wherein the flex ribbon is configured to be twisted to cause a misalignment between the one or more magnets of the flex ribbon and the one of more magnets of the connector.

12. The apparatus of claim 11, wherein the flex ribbon is further configured to disengage from the connector in response to the misalignment by reducing a magnetic force between the one or more magnets of the flex ribbon and the one of more magnets of the connector.

13. A connector into which a flex ribbon is inserted to make an electrical connection, the flex ribbon having first and second sides, the first side being opposite the second site, the flex ribbon having one or more traces on the first side, a ground plane on at least a portion of the second side, and turn-up regions, the connector comprising:

a signal bridge to electrically connect contacts of the connector to the one or more traces of the flex ribbon; and a metal shell to make an electrical contact with the ground plane via the turn-up regions while having contacts in electrical contact with the one or more traces.

14. The connector defined in claim 13 further comprising one or more wiping parts coupled to the shell to clean the flex ribbon when being inserted into the connector.

15. The connector defined in claim 13 further comprising a guide to direct the flex ribbon into the connector.

16. The connector defined in claim 13 wherein the signal bridge electrically connects the contacts of the connector to contacts on the flex ribbon that are connected to the one or more traces.

17. The connector defined in claim 13 further comprising one or more magnets that align with one or more magnets coupled to the flex ribbon to hold the flex ribbon into the connector.

* * * * *

UNITED STATES PATENT AND TRADEMARK OFFICE

CERTIFICATE OF CORRECTION

PATENT NO. : 8,920,188 B2
APPLICATION NO. : 13/779372
DATED : December 30, 2014
INVENTOR(S) : Bruce Richardson It is certified that error appears in the above-identified patent and that said Letters Patent is hereby corrected as shown below:

Title page, item (57), Abstract:
Line 5, replace "second site," with -- second side --.

In the Claims:
Column 5, Claim 9, lines 4-5, replace "...portion of the second side, the flex ribbon comprises and one or more..." with -- ...portion of the second side, and one or more... --.
Column 6, Claim 13, line 3, replace "...opposite the second site..." with -- ...opposite the second side... --.

Signed and Sealed this
Fifth Day of July, 2016

Michelle K. Lee

Michelle K. Lee
*Director of the United States Patent and Trademark Office*